United States Patent [19]

Owen

[11] Patent Number: 4,957,453

[45] Date of Patent: Sep. 18, 1990

[54] ELECTRICAL SOCKET

[75] Inventor: Leonard J. Owen, Watford, England

[73] Assignee: AMP Incorporated, Harrisburg, Pa.

[21] Appl. No.: 432,296

[22] Filed: Nov. 6, 1989

[51] Int. Cl.[5] ..... H01R 4/24

[52] U.S. Cl. ..... 439/422

[58] Field of Search ..... 439/67, 77, 421, 422, 439/492, 494–499

[56] References Cited

U.S. PATENT DOCUMENTS

| | | | |
|---|---|---|---|
| 3,395,381 | 7/1968 | Huffnagle | 339/97 |
| 3,845,456 | 10/1974 | Michaels | 339/97 R |
| 4,002,393 | 1/1977 | Merry et al. | 339/97 C |
| 4,357,065 | 11/1982 | Kam et al. | 339/97 R |

FOREIGN PATENT DOCUMENTS

| | | |
|---|---|---|
| 2051273 | 5/1971 | Fed. Rep. of Germany . |
| 2100062 | 2/1972 | France . |
| 1400466 | 7/1975 | United Kingdom . |

*Primary Examiner*—Joseph H. McGlynn
*Attorney, Agent, or Firm*—Eric J. Groen

[57] ABSTRACT

An electrical socket for mounting on a flat, flexible conductor carrier (FFC), for connecting an electrical plug (P) to a conductor (C) on the conductor carrier (FFC), comprises a base plate having a central plug receiving opening. A pair of contact springs extend from opposite edges of the base plate and have arcuate contact surfaces which project across the opening on one face of the plate for resiliently engaging the plug (P) between them. On each side of the opening is a pair of lugs depending from the other face of the plate and being adapted to be passed through the conductor carrier (FFC) and curled round towards each other to make electrical contact with the conductor (C). In use, the plug (P) is passed through the opening in a direction normally of the plane of the base plate, and through the conductor carrier (FFC).

2 Claims, 2 Drawing Sheets

ELECTRICAL SOCKET

This invention relates to an electrical socket for mounting on a flat, flexible cable or on a flat, flexible printed circuit, for the electrical connection of an electrical plug to a conductor of the cable or circuit. Such a cable or circuit will hereinafter be referred to as "a flat, flexible, conductor carrier."

There is disclosed in U.S. Pat. No. 3,675,180, an electrical socket for mounting on a flat, flexible, conductor carrier for the electrical connection of an electrical plug to a conductor of said conductor carrier, the socket comprising a base plate having a plug receiving opening and a receptacle projecting from one face of the base plate, for a plug inserted through the plug-receiving opening substantially normally of the base plate, there projecting from the base plate, upon each of two sides of said opening, a pair of lugs which are deformable for engagement about the conductor.

In the socket disclosed in U.S. Pat. No. 3,675,180, the receptacle is in the form of a circular cross section funnel which has been drawn from the base plate, or has been riveted thereto, and surrounds the opening, the lugs projecting from the same side of the base plate as the funnel. In order to allow the socket to be applied to the conductor carrier, an enlarged pad of the conductor is preformed with a central hole to receive the funnel there through.

The present invention is intended to provide a socket which can readily be stamped and formed from a single piece of sheet metal stock without the need for a drawing operation, and for the application of which socket to the conductor carrier, the conductor need not have a pad with a pre-formed hole therein, so that the socket can be applied to any desired conductor of the conductor carrier at an desired position along its length.

According to the present invention, therefore, the receptacle comprises a pair of contact springs, each being of substantially semicircular shape, the contact springs presenting opposed, arcuate contact surfaces which are bowed towards each other and extend across the plug-receiving openings to engage the plug between them; the lugs projecting from the other face of the base plate, that is to say from the face opposite to that from which the contact springs project.

Thus, the socket, which can readily be stamped and formed from a single piece of sheet metal stock, can be secured to one side of a flat, flexible conductor carrier to terminate any conductor thereof at any desired position along its length, simply by inserting the lugs through the cable and deforming them so as to engage about the conductor, whereafter the plug can be inserted between the contact springs, through the opening in the base plate, and through the conductor carrier to establish electrical contact between the conductor and the plug by way of the socket. Since the lugs project from the opposite face of the base plate to that from which the contact springs project, the receptacle does not need to be inserted through the conductor.

Although the conductor is pierced where the plug is passed through it, the first part of the conductor is electrically bridged by the base plate, since the latter is electrically connected to the conductor by the pairs of lugs on each side of the opening in the base plate.

The base plate is preferably formed with resilient spurs projecting from said other face of the plate, each spur protruding between the lugs of a respective pair, the lugs having free end portions which taper away from the base plate and terminate in chamfered edges for cooperation with the spurs to grip the cable conductor, thereby to enhance the integrity of both the mechanical and the electrical connections between the socket and the conductor.

Although the conductor may be preformed with a hole to receive the plug this should be unnecessary where the plug has the usual tapered leading end.

For a better understanding of the invention, reference will now be made by way of example to the accompanying drawings in which.

Figure 1:
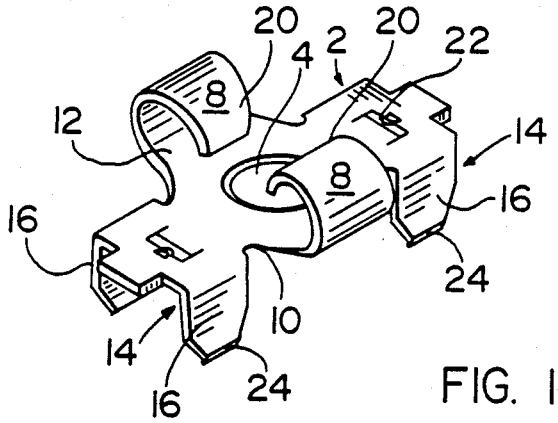
FIG. 1 is an isometric view of an electrical socket for mounting on a flat, flexible cable or on a flat, flexible, conductor carrier, for the connection of an electrical plug to a conductor thereof.
Figure 2:
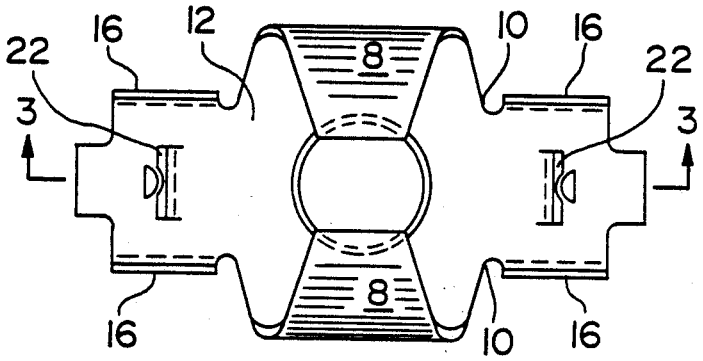
FIG. 2 is an enlarged top plan view of the socket.
Figure 3:
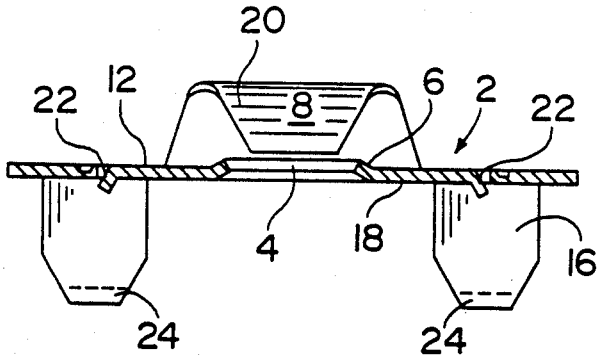
FIG. 3 is a view taken on the lines 3—3 of FIG. 2.

Reference will now be made to FIGS. 1 to 4. The socket, which has been stamped and formed from a single piece of sheet metal stock, comprises an elongate base plate 2 having a central, plug receiving, circular opening 4 having a raised edge 6, a pair of contact springs 8 extending from opposite longitudinal edges 10 of the plate 2 and overlapping one face 12 thereof, and two crimping ferrules 14 one on each side of the opening 4, and each being proximate to a respective end of the plate 2. Each ferrule 14 comprises a pair of opposed lugs 16, spaced from each other transversely of the plate 2. The lugs 16 of each pair extend from opposite longitudinal edges thereof and depend from the other face 18 of the plate 2 normally thereof. The edge 6 of the opening 4 upstands from the face 12 of the plate 2.

Figure 4:
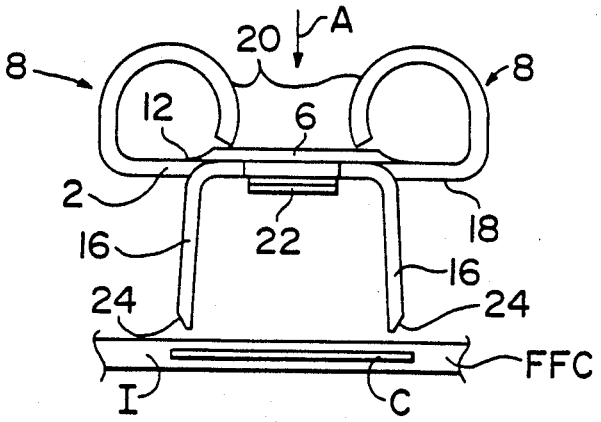
FIG. 4 is an end view of the socket when about to be assembled to the conductor carrier.

The contact springs 8 which are arcuate and are of substantially semicircular shape, as best seen in FIG. 4, are smoothly curved inwardly of the plate 2 and present oppositely bowed contact surfaces 20 which overlie the opening 4. Each lug 16 tapers towards a chamfered free edge 24 thereof remote from the plate 2. The plate 2 has, struck out therefrom, a pair of resilient spurs 22 each of which depends from the face 18 of the plate 2 between a respective pair of the lugs 16.

Figure 5:
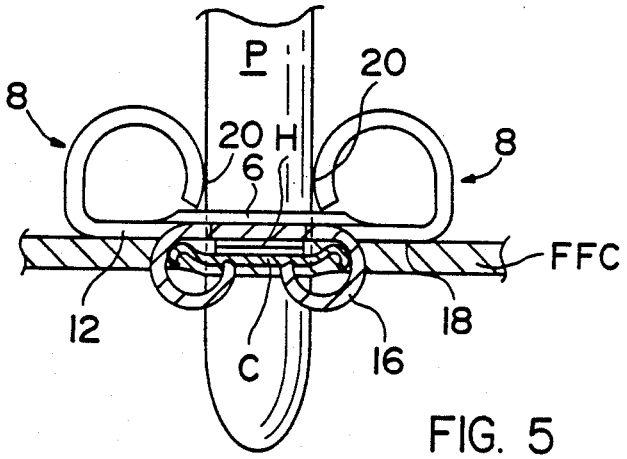
FIG. 5 is an end view, shown partly in section, showing the socket crimped to the conductor carrier and mated with the plug.
Figure 6:
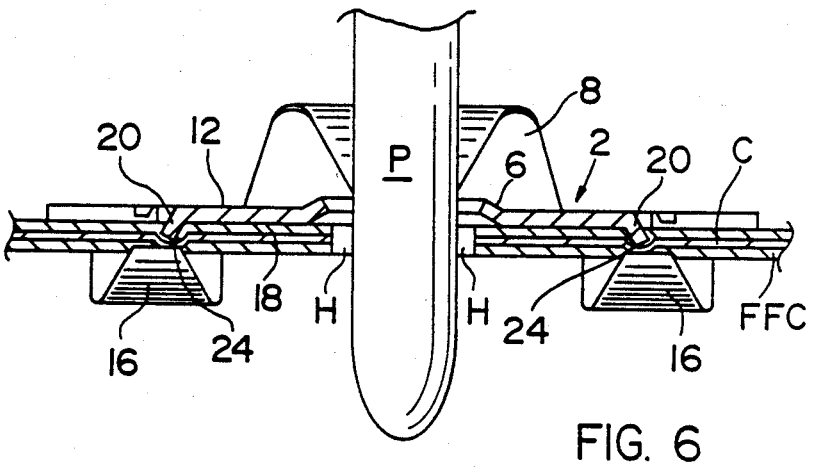
FIG. 6 is a longitudinal sectional view showing the socket crimped to the conductor carrier and mated with the plug.

The socket is for assembly to a flat, flexible, conductor carrier FFC which is shown in fragmentary form in FIGS. 4 to 6. The conductor carrier FFC has conductors C, only one of which is shown, extending at right angles to the plane of FIGS. 4 to 6, the conductors C being imbeded in the insulation I of the conductor carrier FFC.

In order to assemble the socket to the conductor carrier FFC, the lugs 16 are inserted through the conductor carrier FFC in the direction of the arrow A in FIG. 4, by means of a suitable tool (not shown), their chamfered edges 24 serving to pierce the conductor carrier FFC, until the plate 2 is seated on the upper side of the conductor carrier FFC, the lugs 16 being simultaneously bent round by cooperation between the tool and an anvil (not shown), towards the underside of the conductor carrier FFC so that the chamfered ends 24 pierce the insulation I from beneath and make electrical contact with the conductor C, as shown in FIGS. 5 and 6. As shown in FIG. 6, the conductor C is thereby gripped firmly and resiliently between the spurs 22 and the chamfered edges 24 of the lugs 16.

In order, electrically to connect an electrical plug P with the conductor C, the tapered leading end of the plug P is inserted between the contact surfaces 20 of the contact springs 8, through the opening 4 in the plate 2 and through the conductor carrier FFC, the plug P passing through the conductor C thereof. The conductor carrier FFC may, if needed, be preformed with a hole H in order to facilitate the insertion of the plug P, especially if its leading end is too blunt to pierce the conductor C. Although the inserted plug P extends through the conductor C and thereby reduces its conductivity in the region of the plug P, the reduced conductivity portion of the conductor C is bridged by the plate 2, which is electrically connected to the conductor C by the ferrules 14, on either side of the opening 4. In the inserted position of the plug P, the plug P is firmly and resiliently gripped between the bowed contact surfaces 20 of the contact springs 8 and is thereby electrically connected to the conductor C.

I claim:

1. An electrical socket for mounting on a flat, flexible conductor carrier (FFC), for the electrical connection of an electrical plug to a conductor of said conductor carrier (FFC), the socket comprising a base plate having a plug-receiving opening and a receptacle projecting from one face of the base plate, for a plug inserted through the plug-receiving opening substantially normally of the base plate, there projecting from the base plate upon each of two opposite sides of the opening, a pair of lugs which are deformable for engagement about said conductor (C); characterized in that the plug receptacle comprises a pair of contact springs, each being of substantially semicircular shape, the contact springs presenting opposed, arcuate contact surfaces which are bowed towards each other and extend across the plug-receiving opening to engage the plug (P) between them, the lugs projecting from the other face of the base plate.

2. A socket according to claim 1, characterized in that the base plate is formed with resilient spurs projecting from said other face of the plate, each spur protruding between the lugs of a respective pair, the lugs having free end portions which taper away from the base plate and terminate in chamfered edges for cooperation with the spurs to grip the conductor (C).

* * * * *